US007669274B2

(12) United States Patent
Cooper et al.

(10) Patent No.: US 7,669,274 B2
(45) Date of Patent: Mar. 2, 2010

(54) DEVICE FOR RESTORING LIGHT PERMEABILITY OF MOTOR VEHICLE HEADLIGHT LENSES

(75) Inventors: Alex Cooper, Brooklyn, NY (US); Yevgeny Bederak, Long Meadow, MA (US); Sergey Vladimirtsev, Brooklyn, NY (US)

(73) Assignee: Universal Photonics, Hicksville, NY (US)

( * ) Notice: Subject to any disclaimer, the term of this patent is extended or adjusted under 35 U.S.C. 154(b) by 0 days.

(21) Appl. No.: 12/157,344

(22) Filed: Jun. 11, 2008

(65) Prior Publication Data

US 2009/0311950 A1 Dec. 17, 2009

(51) Int. Cl.
*A47L 13/46* (2006.01)

(52) U.S. Cl. ..... 15/244.1; 15/244.3

(58) Field of Classification Search ..... 15/244.1, 15/244.3

See application file for complete search history.

(56) References Cited

U.S. PATENT DOCUMENTS

| | | | | |
|---|---|---|---|---|
| 2,899,932 | A * | 8/1959 | Bennett | 15/423 |
| 6,044,512 | A * | 4/2000 | Hornby et al. | 15/97.1 |
| 6,199,240 | B1 * | 3/2001 | You | 15/121 |
| 6,604,990 | B2 * | 8/2003 | Cooper et al. | 451/526 |
| 7,111,585 | B2 * | 9/2006 | Hale et al. | 119/652 |

* cited by examiner

*Primary Examiner*—Shay L Karls
(74) *Attorney, Agent, or Firm*—I. Zborovsky

(57) ABSTRACT

A device for restoring a light permeability of headlight lenses of motor vehicles has a holder, a working layer attached to the holder and adapted to clean and polish a surface of a headlight lense when the device is moved relative to the latter, and a sponge-like element located between the holder and the working layer and formed so that it applies an elastic biasing action to the working layer to provide a cleaning and polishing action by the working layer and at the same time to absorb a liquid required for the cleaning and polishing action.

1 Claim, 2 Drawing Sheets

DEVICE FOR RESTORING LIGHT PERMEABILITY OF MOTOR VEHICLE HEADLIGHT LENSES

BACKGROUND OF THE INVENTION

The present invention relates to a device for restoring light permeability of headlight lenses of motor vehicles.

It is known that after a certain use of motor vehicles the light permeability of headlight lenses is substantially reduced due to their dirtying and wear. In an attempt to restore the light permeability of the headlight lenses users clean them with water or chemical solutions, using various carriers. It is believed that it would be advisable to provide an improved device for restoring light permeability of motor vehicle headlight lenses.

SUMMARY OF THE INVENTION

Accordingly, it is an object of the present invention to provide a device for restoring light permeability of headlight lenses of motor vehicles, which provides efficient and non destructive cleaning and clearing of headlight lenses.

In keeping with these objects and with others which will become apparent hereinafter, one feature of the present invention resides, briefly stated, in a device for restoring a light permeability of headlight lenses of motor vehicles, comprising a holder; a working layer attached to said holder and adapted to clean and polish a surface of a headlight lense when the device is moved relative to the latter; and a sponge-like element located between said holder and said working layer and formed so that it applies an elastic biasing action to said working layer to provide a cleaning and polishing action by said working layer and at the same time to absorb a liquid required for the cleaning and polishing action.

When the device is designed in accordance with the present invention, it provides a simple, convenient and efficient tool for restoring the light permeability of headlight lenses of motor vehicles, by cleaning and polishing the headlight lenses. During cleaning and polishing, dirt is removed from the surface of the lense and the lense is polished to restore its light permeability.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
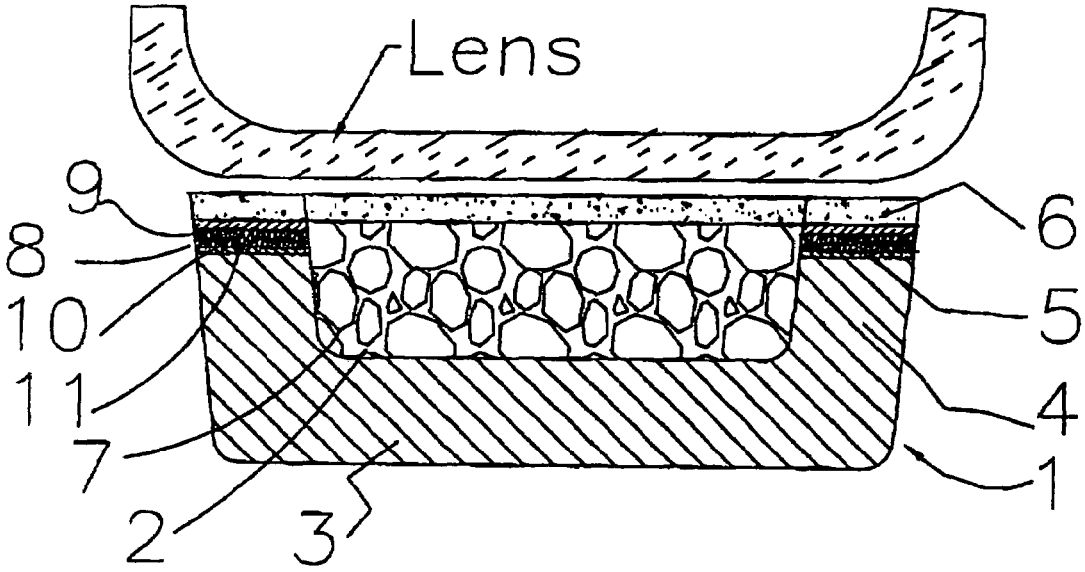
FIG. 1 is a view showing a device for restoring a light permeability of headlight lenses of motor vehicles, in accordance with the present invention.

A device for restoring a light permeability of headlight lenses in vehicles as shown in FIG. 1 has a holder identified as a whole with reference numeral 1. The holder 1 can be substantially rectangular on a plan view. It has an inner cavity which is identified with reference numeral 2 and formed by bottom 3 and an upstanding flange 4 provided with surface 5. A working layer 6 is attached to the upstanding flange 4 and extends completely across the holder 1. It is connected to the surface 5 of the upstanding flange 4, as will be explained herein below, and covers the inner hollow 2 of the holder.

A sponge-like element 7 is located in the cavity 2 of the holder 1. The sponge-like element 7 first of all has elastic or springy properties, so that when it is located in the cavity 2 of the holder 1 between the bottom 3 of the holder 1 and the working layer 6, it urges the working layer 6 upwardly in FIG. 1 with a tender, springy or elastic action toward a headlight lense L to be treated, so that a certain rubbing or polishing action by the working layer 6 of the headlight lense is provided, but the headlight lense is not damaged. On the other hand, the sponge-like element 7 performs another function, in particular in absorbing and containing liquid, such as for example water or cleaning solution, etc. which is necessary during the operation of cleaning and polishing of a headlight lense.

The working layer 6 is formed porous so that on the other hand the sponge-like element 7 can be impregnated with water or another liquid by immersing the device into a container with liquid, and on the other hand, when the device is applied to a headlight lense, the liquid can be squeezed from the sponge-like element into a zone between the device and the headlight lense. For this purpose at least a part of the holder 1 can be made elastic, for example by producing it from an elastic plastic material, so that by deflecting this part inwardly the sponge-like element 7 can be squeezed to release liquid which will then pass through the working layer.

The working layer 6 is connected with the holder 1 by an attaching structure which can be formed for example as a VELCRO connection. For this a purpose one part of the VELCRO connection, for example provided with hooks 8 is attached to the working layer 6 by a connecting layer 9 formed for example as an adhesive layer, while another part of a VELCRO connection 10 provided for example with loops is connected to the surface 5 of the holder 1 by another connecting layer 11 which can be formed as an adhesive layer. The working layer, the attaching structure including the VELCRO connection, and the connecting layers can be composed of such materials that a heat hardenable material of the working layer and the connection layers are hardenable substantially at a same temperature and substantially with a same pressure, as disclosed for example in our U.S. Pat. No. 6,604,990. The working layer 6 can include the above mentioned heat hardenable material with a plurality of abrasive grains and a heat hardenable body as also disclosed in the above mentioned U.S. Pat. No. 6,604,990.

Figure 2:
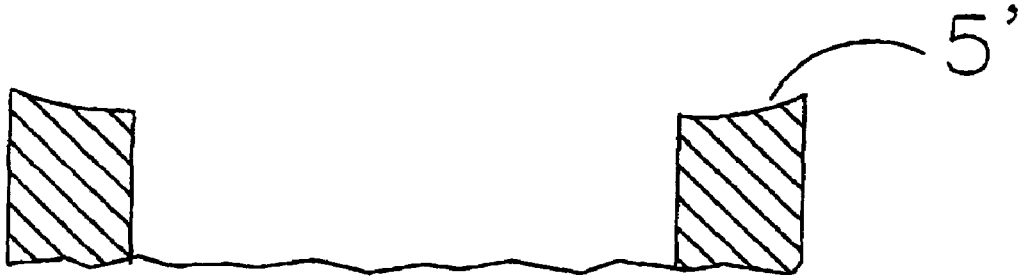
FIG. 2 is a view showing a holder of the inventive device for restoring a light permeability of headlight lenses, in accordance with another embodiment of the present invention.

In accordance with a further embodiment of the present invention shown in FIG. 2, the surface 5' of the holder 1' of the inventive device can be provided with a slight curvature, substantially corresponding to the curvature of the headlight lenses to be cleaned. With this approach, the working layer 6 attached to the surface 5' assumes also a curved shape substantially corresponding to the curved shape of the headlight lense to be cleaned and polished.

Figure 3:
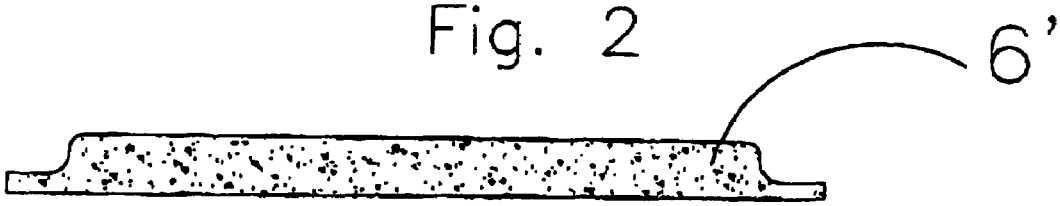
FIG. 3 is a view showing a working layer of the device for restoring a light permeability of headlight lenses in accordance with a preferable embodiment of the present invention.

In accordance with still a further feature of the present invention shown in FIG. 3, the working layer 6' of the inventive device for increasing light permeability of headlight lenses has a greater thickness in a central area and a smaller thickness in the peripheral area obtained for example by compression of the peripheral area during the manufacture of the device by application of heat and pressure, as disclosed in our previous U.S. patent application. With such a construction the central part of the working layer is more elastic and provides better cleaning and polishing of the headlight lenses.

Figure 4:
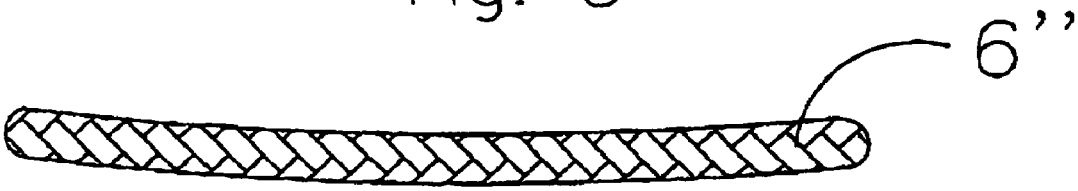
FIG. 4 is a view showing a further modification of the working layer of the device for restoring a light permeability of headlight lenses in accordance with the present invention.

In accordance with still a further feature of the present invention, a locking layer 6" of the device is formed curved during the manufacturing of the device. In order to manufacture the device, the working layer is applied through the intermediate layers shown in FIG. 1, onto the upper surface of the outstanding flange of the holder 1, and the device is subjected to heat and pressure treatment. During the treatment, due to forces generated in the working layer, the working layer naturally assumes the curved shape shown in FIG. 4, as a result of surface stresses.

It will be understood that each of the elements described above, or two or more together, may also find a useful application in other types of constructions differing from the types described above.

While the invention has been illustrated and described as embodied in device for restoring light permeability of motor vehicle headlight lenses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for restoring a light permeability of headlight lenses of motor vehicles, comprising a holder having an axis; a working layer attached to said holder and adapted to clean and polish a surface of headlight lenses by the device is moved relative to the latter; and a sponge-like element located between said holder and said working layer and formed so that it applies an elastic biasing action to said working layer to provide a cleaning and polishing action by said working layer and at the same time to absorb a liquid required for a cleaning and polishing action, wherein said holder has a cavity and a circumferential surface extending around an opening of said cavity, wherein said cavity accommodates said sponge-like element, while said circumferential surface holds said working layer, wherein said circumferential surface around the opening of said cavity is curved substantially in correspondence with a curvature of a headlight lense to be cleaned and polished, and wherein said working layer is curved as a whole substantially in correspondence with the curvature of the headlight lense to be cleaned and polished, an attaching layer for attaching said working layer to said holder and formed as a VELCRO connection having two opposite axial surfaces facing away from one another; and two connecting layers provided on said opposite axial surfaces of said VELCRO connection which connect said attaching layer to said working layer and said holder correspondingly, said attaching layer and said connecting layers being provided only in an area of said circumferential surface of the holder around said opening of said cavity.

* * * * *